United States Patent [19]

Rauch

[11] 4,069,954

[45] Jan. 24, 1978

[54] GOLFER'S WRIST BAND FOR CARRYING TEES AND BALL POSITION MARKERS

[76] Inventor: Frank E. Rauch, 7240 S. Millard Ave., Chicago, Ill. 60629

[21] Appl. No.: 713,708

[22] Filed: Aug. 12, 1976

[51] Int. Cl.[2] ..... A45F 5/00; A45C 11/00

[52] U.S. Cl. ..... 224/5 C; 224/28 B; 224/28 D; 273/32 A

[58] Field of Search ..... 224/5 C, 28 R, 28 B, 224/28 D; 273/32 R, 32 C, 32 A

[56] References Cited

U.S. PATENT DOCUMENTS

| | | | |
|---|---|---|---|
| 1,588,461 | 6/1926 | Ladue | 224/5 C |
| 1,806,797 | 5/1931 | Guiterman | 224/5 C |
| 3,753,519 | 8/1973 | Gammon | 224/5 C |
| 3,830,415 | 8/1974 | Jacobson et al. | 224/5 C |

FOREIGN PATENT DOCUMENTS

| | | | |
|---|---|---|---|
| 300,428 | 11/1928 | United Kingdom | 224/5 C |

*Primary Examiner*—George J. Marlo
*Attorney, Agent, or Firm*—Wegner, Stellman, McCord, Wiles & Wood

[57] ABSTRACT

A wrist band of longitudinally extensible fabric is provided with strips of hooked pile fabric to secure it snugly to a golfer's wrist, and is provided with a web that is stitched to form three loops to hold golf tees and two pairs of elastic tapes to hold golf ball position markers with the marker discs confined beneath the tapes and the marker studs projecting between the tapes.

16 Claims, 3 Drawing Figures

GOLFER'S WRIST BAND FOR CARRYING TEES AND BALL POSITION MARKERS

BACKGROUND OF THE INVENTION

Golfers must carry a supply of wooden or plastic tees, and many golfers at the present time also carry small plastic ball position markers which are used on the green to precisely mark the position of a ball that is picked up to avoid a stymie of a player who must putt first, or to avoid having a ball close enough to the player's line of sight to distract him. Such ball position markers customarily consist of a small plastic disc with a stud centered on one surface to be pressed into the turf of the green. It is difficult to carry tees and ball position markers in a pocket because they have sharp ends which tend to damage a pocket, and the golfer may run the tip under a fingernail when he reaches into the pocket.

Some golf bags are equipped with small loops to hold a few tees, but others are not; and in any case the golfer must remember to take a tee from the bag when he selects a club for a tee shot, and if he forgets to do so there are some situations where he has left his bag a considerable distance from the tee because of the location of the tee and fairway relative to the green on the last hole played.

It is most inconvenient for golf ball position markers to be carried upon the bag, because the bag cannot be taken onto the green, and the golfer often does not know that he will need to use a ball position marker until he is on the green and has seen the relative locations of the various golf balls, on the green. Further, a marker may be needed only after a golfer has played his first putt.

Applicant has not heretofore been aware of any small, convenient device for carrying tees and ball position markers on the person during a game, and which can be stored in the ball pocket of a golf bag when not in use.

SUMMARY OF THE INVENTION

The principal object of the present invention is to provide a convenient means for a golfer to carry a small supply of tees and golf ball position markers on his person during a game.

Another object of the invention is to provide such a device which is entirely independent of the golfer's clothing but which nevertheless locates the tees and golf ball position markers where they are always conveniently available.

Still another object of the invention is to provide a device which neither interferes with the golfer's freedom of movement nor interferes with his concentration.

Still another object of the invention is to provide a device which is sufficiently small and compact that it may be stored in the ball pocket of a golf bag when not in use.

THE DRAWINGS

DETAILED DESCRIPTION OF THE INVENTION

Figure 1:
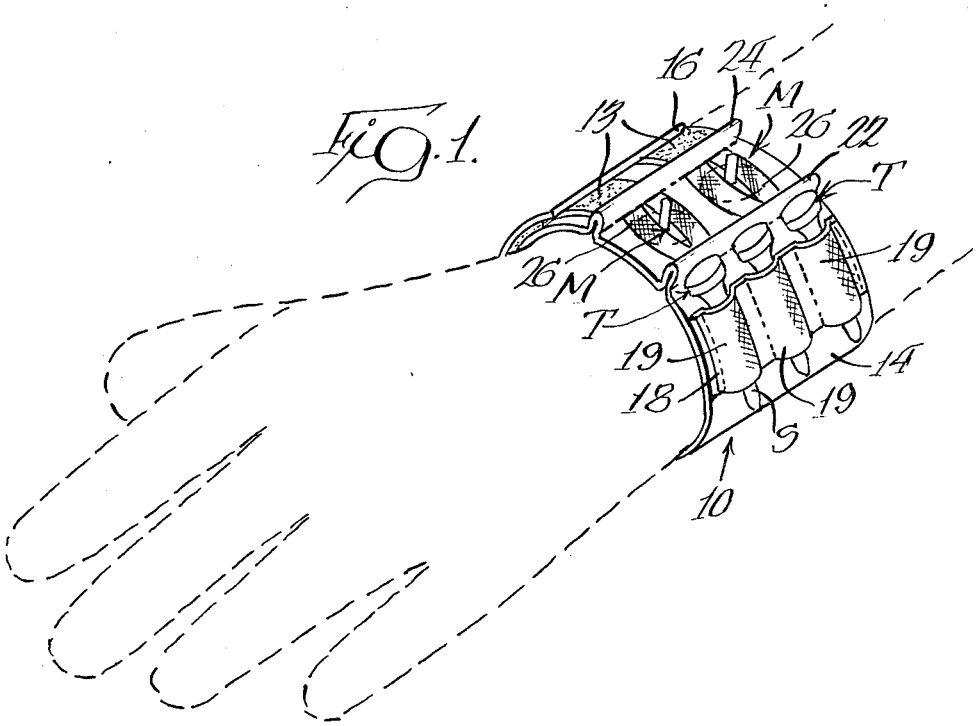
FIG. 1 is a perspective view of the device of the invention in position upon a person's wrist which is illustrated in broken lines.

Referring to the drawings in detail, the device of the invention consists of a wrist band, indicated generally at 10, which preferably consists of a strip of longitudinally extensible fabric of a readily commercially available type. The band has an outer surface 11 near one end 12 of which two longitudinally extended strips 13 of hooked pile fabric are secured by means of textile stitching; and it also has an undersurface 14 with a strip 15 of cooperating hooked pile fabric secured by textile stitching adjacent the opposite end 16. It is understood that in the present disclosure the term "hooked pile fabric" is used to describe both the strips 13 and the strip 15, even though they are not identical material, and even though the "pile" of the strip 15 consists of relatively rigid plastic hooks which engage in the fabric pile of the strips 13 so as to permit the user to lap the end 16 over the end 12 only far enough to cause the wrist band 10 to fit snugly about the wrist. Suitable cooperating hook pile fabrics 13 and 15 are, of course, commercially available under the trademark VELCRO.

Between the two ends of the wrist band 10 is a web, indicated generally at 17, which extends across the band and is secured thereto by longitudinally extending parallel lines 18 of textile stitching which define three loops 19 each of which may receive a tee T which has a pointed cylindrical shank S and an enlarged head H. The lines of textile stitching 18 between adjacent loops 19 are spaced to form intermediate strips 20 so that tees may be placed in all three loops with their heads H at the same end and without interference between the heads.

Figure 2:
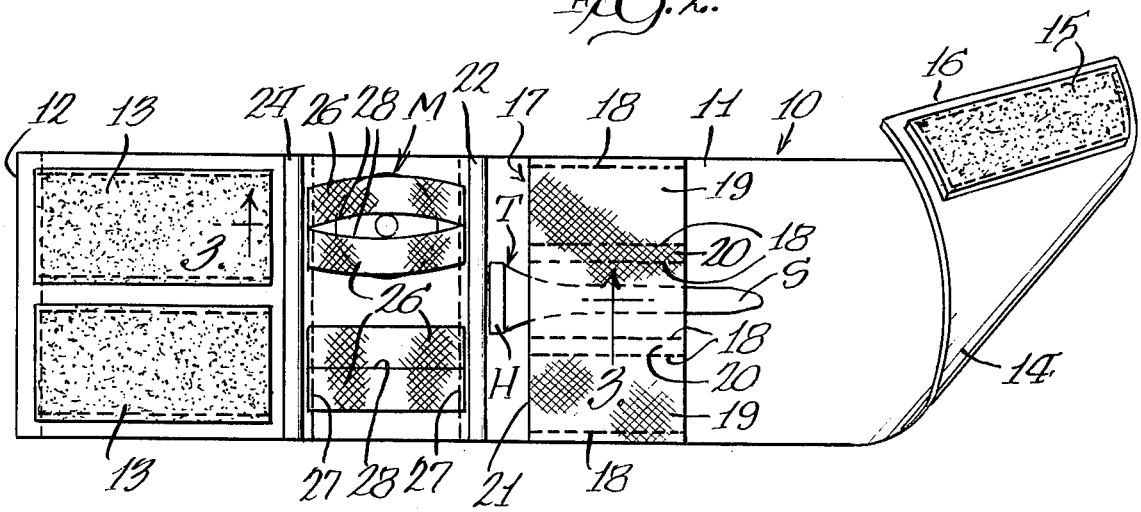
FIG. 2 is a plan view of the device drawn on a scale of 1 to 1 with one end of the wrist band turned back to show both parts of the securing means and with one tee and one golf ball position marker in the device.
Figure 3:
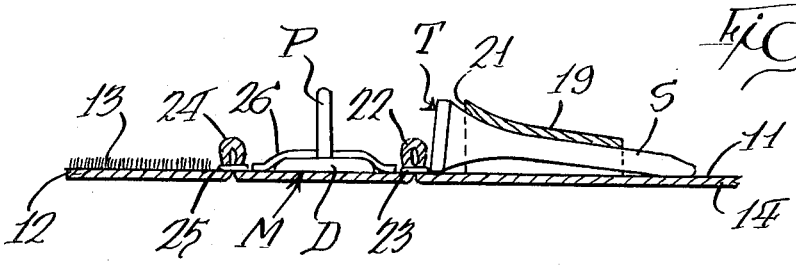
FIG. 3 is a fragmentary longitudinal sectional view taken substantially as indicated along the line 3—3 of FIG. 2.

Spaced from the ends 21 of the loops 19 by a sufficient distance to accommodate the tee heads H is a small ridge 22 which is formed by a loop of the fabric that forms the band 10 with textile stitching 23 therethrough; and spaced from the ridge 22 is a second identical ridge 24 which is held by textile stitching 25. The space between the ridges 22 and 24 is occupied by two longitudinally extending pairs of elastic tapes 26 the ends of which are secured to the band 10 by textile stitching 27 with the adjacent longitudinal edges 28 of the elastic tapes of each pair being substantially abutting. Each pair of tapes holds a golf ball position marker M with its disc D confined beneath the tapes 26 of the pair and its stud or pin P projecting between the tapes. It is obvious from FIGS. 2 and 3 that the length of the elastic tapes 26 is slightly greater than the diameter of the ball position marker disc D so that the latter may be received easily beneath the tapes 26.

The foregoing detailed description is given for clearness of understanding only and no unnecessary limitations should be understood therefrom, as modifications will be obvious to those skilled in the art.

I claim:

1. A golfer's device for carrying golf tees which have pointed cylindrical shanks with enlarged heads and a golf ball position marker consisting of a disc with an integral stud to penetrate the turf of a green, said device comprising, in combination:

a wrist band of limp material;

means for securing said band snugly about wrists of different sizes;

a web secured to said band along a plurality of parallel lines to define loops positioned side by side which snugly receive the shanks of several golf tees with the enlarged head of each tee projecting from an end of a loop;

and a pair of elastic tapes which are slightly longer than the diameter of a ball position marker disc and have their ends secured to the band, said elastic tapes having substantially abutting edges so that a ball position marker disc may be inserted beneath the tapes by spreading them apart and is then confined beneath the tapes with its stud projecting between the tapes.

2. The combination of claim 1 which has two pairs of elastic tapes side by side to receive two ball position markers.

3. The combination of claim 1 in which the web extends across the band and the lines along which it is secured are parallel to the length of the band.

4. The combination of claim 3 in which the elastic tapes extend lengthwise of the band and have an end spaced from the loops by a distance slightly greater than the distance that the head of a tee projects from a loop.

5. The combination of claim 1 in which the band consists of a longitudinally extensible fabric.

6. The combination of claim 5 in which the means for securing the band consists of longitudinally extended cooperating strips of hooked pile fabric at opposite ends and on opposite surfaces of said band.

7. The combination of claim 1 in which the web is secured to the band by parallel lines of textile stitching which extend along the sides of the band and along at least two areas between the sides of the band.

8. The combination of claim 7 in which two closely spaced lines of textile stitching define the sides of two adjacent loops so that said loops are laterally spaced to prevent interference between the adjacent heads of two tees.

9. The combination of claim 1 in which the means for securing the band consists of longitudinally extended cooperating strips of hooked pile fabric at opposite ends and on opposite surfaces of said band.

10. A golfer's device for carrying golf tees which have pointed cylindrical shanks with enlarged heads and a golf ball position marker consisting of a disc with an integral stud to penetrate the turf of a green, said device comprising, in combination:

a wrist band of limp, longitudinally extensible fabric;

means for securing said wrist band snugly about wrists of different sizes, said means consisting of longitudinally extended cooperating strips of hooked pile fabric at opposite ends and on opposite surfaces of said band;

a web secured to said band by a plurality of parallel lines of textile stitching which define loops positioned side by side with sufficient space between them that each loop may receive the shank of a golf tee with the enlarged heads of all the tees in adjacent, non-interfering positions;

two parallel ridges extending across said band, each of said ridges consisting of a loop of the band fabric with textile stitching therethrough, one of said ridges being close to the loops and there being a space between the ridges which is slightly greater than the diameter of a ball position marker disc;

and a pair of elastic tapes between said ridges, said tapes being slightly longer than the diameter of a ball position marker disc and having their ends secured to the band by textile stitching, and said tapes having substantially abutting edges so that a ball position marker disc may be confined beneath the tapes with its stud projecting between the tapes.

11. The combination of claim 10 in which the web extends across the band, the parallel lines of textile stitching extend lengthwise of the band, and one end of the loops is so spaced from the adjacent ridge that the projecting head of a tee is confined between the end of a loop and the ridge.

12. The combination of claim 11 in which there are two pairs of elastic tapes which extend lengthwise between the parallel ridges.

13. A golfer's device for carrying golf tees which have pointed cylindrical shanks with enlarged heads and a golf ball position marker consisting of a disc with an integral stud to penetrate the turf of a green, said device comprising, in combination:

a wrist band of limp material;

means for securing said wrist band snugly about wrists of different sizes;

a web extending across said band and secured thereto along a plurality of parallel lines which extend lengthwise of the band to define loops positioned side by side which snugly receive the shanks of several golf tees with the enlarged head of each tee projecting from an end of a loop;

a pair of elastic tapes which extend lengthwise of the band and are slightly longer than the diameter of a ball position marker disc, said elastic tapes having their ends secured to the band with one end spaced from the loops by a distance slightly greater than the distance that a head of a tee projects from the loops, and said tapes having substantially abutting edges so that a ball position marker disc may be confined beneath the tapes with its stud projecting between the tapes;

and an integral, outwardly projecting narrow ridge extending across the band between the ends of the elastic tapes and the loops, there being space for the projecting head of a tee between the loops and the ridge.

14. The combination of claim 13 which includes a second integral, outwardly projecting, narrow ridge immediately adjacent the other end of the elastic tapes.

15. The combination of claim 13 in which the web is secured to the band by parallel lines of textile stitching which extend along the sides of the band and along at least two areas between the sides of the band.

16. The combination of claim 15 in which two closely spaced lines of textile stitching define the sides of two adjacent loops so that said loops are laterally spaced to prevent interference between the adjacent heads of two tees.

* * * * *